US006991037B2

(12) United States Patent
Hocking

(10) Patent No.: US 6,991,037 B2
(45) Date of Patent: Jan. 31, 2006

(54) MULTIPLE AZIMUTH CONTROL OF VERTICAL HYDRAULIC FRACTURES IN UNCONSOLIDATED AND WEAKLY CEMENTED SEDIMENTS

(75) Inventor: Grant Hocking, Alpharetta, GA (US)

(73) Assignee: GeoSierra LLC, Norcross, GA (US)

( * ) Notice: Subject to any disclaimer, the term of this patent is extended or adjusted under 35 U.S.C. 154(b) by 109 days.

(21) Appl. No.: 10/749,131

(22) Filed: Dec. 30, 2003

(65) Prior Publication Data

US 2005/0145387 A1 Jul. 7, 2005

(51) Int. Cl.
*E21B 43/26* (2006.01)

(52) U.S. Cl. ..... 166/308.1; 166/242.1

(58) Field of Classification Search ..... 166/308.1, 166/305.1, 242.1, 281, 283
See application file for complete search history.

(56) References Cited

U.S. PATENT DOCUMENTS 1,789,993 A 1/1931 Switzer
2,178,554 A 11/1939 Bowie
3,225,828 A 12/1965 Wisenbaker et al.
4,005,750 A * 2/1977 Shuck ..... 166/308.1
4,119,151 A 10/1978 Smith
4,271,696 A 6/1981 Wood
4,432,078 A * 2/1984 Silverman ..... 367/37
4,683,951 A * 8/1987 Pathak et al. ..... 166/271
4,750,562 A * 6/1988 Jennings, Jr. ..... 166/281
4,977,961 A * 12/1990 Avasthi ..... 166/297
5,002,431 A 3/1991 Heymans et al.
5,103,911 A 4/1992 Heijnen
5,372,195 A * 12/1994 Swanson et al. ..... 166/308.1
5,497,658 A * 3/1996 Fletcher et al. ..... 73/152.18
5,564,499 A * 10/1996 Willis et al. ..... 166/299
6,216,783 B1 4/2001 Hocking et al.
6,443,227 B1 9/2002 Hocking et al.

* cited by examiner

*Primary Examiner*—Hoang Dang
(74) *Attorney, Agent, or Firm*—Smith, Gambrell & Russell LLP

(57) ABSTRACT

A method and apparatus for initiating multiple azimuth controlled vertical hydraulic fractures in unconsolidated and weakly cemented sediments from a single bore hole to control the fracture initiation and propagation of hydraulic fractures at differing azimuths, enabling greater yield and recovery of petroleum fluids from the formation. An injection casing with multiple fracture initiation sections is inserted and grouted into a bore hole. A fracture fluid carrying a proppant is injected into the injection casing and opens fracture initiation sections to dilate the formation in a direction orthogonal to the first fracture azimuth plane. Following completion of the first fracture injection, the fracture fluid is injected into the injection casing and opens a set of second and subsequent fracture initiation sections dilating the formation and initiating and propagating a second and subsequent vertical hydraulic fractures at different azimuths to the first and subsequent earlier installed fractures.

25 Claims, 10 Drawing Sheets

MULTIPLE AZIMUTH CONTROL OF VERTICAL HYDRAULIC FRACTURES IN UNCONSOLIDATED AND WEAKLY CEMENTED SEDIMENTS

TECHNICAL FIELD

The present invention generally relates to enhanced recovery of petroleum fluids from the subsurface by injecting a fracture fluid to fracture underground formations, and more particularly to a method and apparatus for creating multiple vertical hydraulic fractures oriented at predetermined differing azimuths in a single well bore in unconsolidated and weakly cemented sediments resulting in increased production of petroleum fluids from the subsurface formation.

BACKGROUND OF THE INVENTION

Hydraulic fracturing of petroleum recovery wells enhances the extraction of fluids from low permeable formations due to the high permeability of the induced fracture and the size and extent of the fracture. A single hydraulic fracture from a well bore results in increased yield of extracted fluids from the formation. The production of petroleum fluids, however, is typically from the region of the formation in close proximity to the fracture and thus large quantities of the petroleum fluids in the formation are not recovered. Creating multiple fractures at differing orientations or azimuths from a single well bore will further increase the yield from the well and result in a much greater recovery of the petroleum reserves from the formation.

Turning now to the prior art, hydraulic fracturing of subsurface earth formations to stimulate production of hydrocarbon fluids from subterranean formations has been carried out in many parts of the world for over fifty years. The earth is hydraulically fractured either through perforations in a cased well bore or in an isolated section of an open bore hole. The horizontal and vertical orientation of the hydraulic fracture is controlled by the compressive stress regime in the earth and the fabric of the formation. It is well known in the art of rock mechanics that a fracture will occur in a plane perpendicular to the direction of the minimum stress, see U.S. Pat. No. 4,271,696 to Wood. At significant depth, one of the horizontal stresses is generally at a minimum, resulting in a vertical fracture formed by the hydraulic fracturing process. It is also well known in the art that the azimuth of the vertical fracture is controlled by the orientation of the minimum horizontal stress in consolidated sediments and brittle rocks.

At shallow depths, the horizontal stresses could be less or greater than the vertical overburden stress. If the horizontal stresses are less than the vertical overburden stress, then vertical fractures will be produced; whereas if the horizontal stresses are greater than the vertical overburden stress, then a horizontal fracture will be formed by the hydraulic fracturing process.

Techniques to induce a preferred horizontal orientation of the fracture from a well bore are well known. These techniques include slotting, by either a gaseous or liquid jet under pressure, to form a horizontal notch in an open bore hole. Such techniques are commonly used in the petroleum and environmental industry. The slotting technique performs satisfactorily in producing a horizontal fracture, provided that the horizontal stresses are greater than the vertical overburden stress, or the earth formation has sufficient horizontal layering or fabric to ensure that the fracture continues propagating in the horizontal plane. Perforations in a horizontal plane to induce a horizontal fracture from a cased well bore have been disclosed, but such perforations do not preferentially induce horizontal fractures in formations of low horizontal stress. See U.S. Pat. No. 5,002,431 to Heymans.

Various means for creating vertical slots in a cased well bore have been disclosed. The prior art recognizes that a chain saw can be used for slotting the casing. See U.S. Pat. No. 1,789,993 to Switzer; U.S. Pat. No. 2,178,554 to Bowie, et al., U.S. Pat. No. 3,225,828 to Wisenbaker; and U.S. Pat. No. 4,119,151 to Smith. Installing pre-slotted or weakened casing has also been disclosed in the prior art as an alternative to perforating the casing, since such perforations can result in a reduced hydraulic connection of the formation to the well bore due to pore collapse of the formation surrounding the perforation. See U.S. Pat. No. 5,103,911 to Heijen. These methods in the prior art were not concerned with the azimuth orientation of two opposing slots for the preferential initiating of a vertical hydraulic fracture at a predetermined azimuth orientation. It has been generally accepted in the art that the fracture azimuth orientation cannot be controlled by such means. These methods were an alternative to perforating the casing to achieve better connection between the well bore and the surrounding formation.

In the art of hydraulic fracturing subsurface earth formations from subterranean wells at depth, it is well known that the earth's compressive stresses at the region of fluid injection into the formation will typically result in the creation of a vertical two "winged" structure. This "winged" structure generally extends laterally from the well bore in opposite directions and in a plane generally normal to the minimum in situ horizontal compressive stress. This type of fracture is well known in the petroleum industry as that which occurs when a pressurized fracture fluid, usually a mixture of water and a gelling agent together with certain proppant material, is injected into the formation from a well bore which is either cased or uncased. Such fractures extend radially as well as vertically until the fracture encounters a zone or layer of earth material which is at a higher compressive stress or is significantly strong to inhibit further fracture propagation without increased injection pressure.

It is also well known in the prior art that the azimuth of the vertical hydraulic fracture is controlled by the stress regime with the azimuth of the vertical hydraulic fracture being perpendicular to the minimum horizontal stress direction. Attempts to initiate and propagate a vertical hydraulic fracture at a preferred azimuth orientation have not been successful, and it is widely believed that the azimuth of a vertical hydraulic fracture can only be varied by changes in the earth's stress regime. Such alteration of the earth's local stress regime has been observed in petroleum reservoirs subject to significant injection pressure and during the withdrawal of fluids resulting in local azimuth changes of vertical hydraulic fractures.

The method of controlling the azimuth of a vertical hydraulic fracture in formations of unconsolidated or weakly cemented soils and sediments by slotting the well bore or installing a pre-slotted or weakened casing at a predetermined azimuth has been disclosed. The method disclosed that a vertical hydraulic fracture can be propagated at a pre-determined azimuth in unconsolidated or weakly cemented sediments. See U.S. Pat. No. 6,216,783 to Hocking et al., and U.S. Pat. No. 6,443,227 to Hocking et al. The method disclosed that a vertical hydraulic fracture can be propagated at a pre-determined azimuth in unconsolidated or weakly cemented sediments. These methods in the prior art were not concerned with the creation of multiple orientated vertical hydraulic fractures at differing azimuths from a single well bore for the enhancement of petroleum fluid production from the formation.

Accordingly, there is a need for a method and apparatus for controlling the differing azimuth orientations of multiple vertical hydraulic fractures in a single well bore in formations of unconsolidated or weakly cemented sediments. Also, there is a need for a method and apparatus that hydraulically connects the installed vertical hydraulic fractures to the well bore without the need to perforate the casing.

SUMMARY OF THE INVENTION

The present invention is a method and apparatus for dilating the earth by various means from a bore hole to initiate and to control the azimuth orientation of multiple vertical hydraulic fractures formed at different azimuths from a single well bore in formations of unconsolidated or weakly cemented sediments. The fractures are initiated by means of preferentially dilating the earth orthogonal to the desired fracture azimuth direction. This dilation of the earth can be generated by a variety of means: a driven spade to dilate the ground orthogonal to the required azimuth direction, packers that inflate and preferentially dilate the ground orthogonal to the required azimuth direction, pressurization of a pre-weakened casing with lines of weaknesses aligned in the required azimuth orientation, pressurization of a casing with opposing slots cut along the required azimuth direction, or pressurization of a two "winged" artificial vertical fracture generated by cutting or slotting the casing, grout, and/or formation at the required azimuth orientation.

Once the first vertical hydraulic fracture is formed, the second and subsequent multiple azimuth orientated vertical hydraulic fractures are initiated by a casing or packer system that seals off the first and earlier fractures and then by preferentially dilating the earth orthogonal to the next desired fracture azimuth direction, the second and subsequent fractures are initiated and controlled. The sequence of initiating the multiple azimuth orientated fractures is such that the induced earth horizontal stress from the earlier fractures is favorable for the initiation and control of the next and subsequent fractures. The first vertical fracture at a predetermined azimuth is initiated and formed resulting in an increase in the horizontal stress perpendicular to the initiated first fracture plane. The second vertical fracture is initiated and formed orthogonal to the first fracture to gain advantage of the favorable horizontal stress regime from the increased horizontal stress created by the first fracture and to achieve a subsequent balancing of the horizontal stress regime following completion of the second fracture. Following the second fracture the earth horizontal stresses are more uniform and thus favorable for the third fracture to be initiated and formed at a different azimuth from the earlier fractures. The fourth vertical fracture is initiated and formed orthogonal to the third fracture because that orientation will experience a favorable horizontal stress field from the installation of the third fracture. The formation of the fourth azimuth controlled fracture will result in a balancing of the horizontal stresses following completion of the injection of the fourth fracture.

The present invention pertains to a method for forming multiple vertical hydraulic fractures from a single borehole to enhance extraction of petroleum fluids from the formation surrounding the borehole. As such any casing system used for the initiation of the fractures will have a mechanism to ensure the casing remains open following the formation of each fracture in order to provide hydraulic connection of the well bore to the hydraulic fractures.

The fracture fluid used to form the hydraulic fractures has two purposes. First the fracture fluid must be formulated in order to initiate and propagate the fracture within the underground formation. In that regard, the fracture fluid has certain attributes. The fracture fluid should not leak off into the formation, the fracture fluid should be clean breaking with minimal residue, and the fracture fluid should have a low friction coefficient.

Second, once injected into the fracture, the fracture fluid forms a highly permeable hydraulic fracture. In that regard, the fracture fluid comprises a proppant which produces the highly permeable fracture. Such proppants are typically clean sand for large massive hydraulic fracture installations or specialized manufactured particles (generally ceramic in composition) which are designed also to limit flow back of the proppant from the fracture into the well bore.

The present invention is applicable only to formations of unconsolidated or weakly cemented sediments with low cohesive strength compared to the vertical overburden stress prevailing at the depth of the hydraulic fracture. Low cohesive strength is defined herein as the greater of 200 pounds per square inch (psi) or 25% of the total vertical overburden stress. Examples of such unconsolidated or weakly cemented sediments are chalk and diatomite formations, which have inherent high porosities and thus large in place petroleum reserves, but low permeability that requires hydraulic fracturing to increase the yield of the petroleum fluids from such formations. Upon conventional hydraulic fracturing such formations will only yield a small fraction of their in place petroleum reserves; whereas multiple azimuth controlled vertical hydraulic fractures in a single well bore have the potential to substantially increase the yield and recoverable reserves from the formation. Another example of unconsolidated and weakly cemented sediments are oil or tar sands, in which the petroleum fluid being a heavy oil or tar is of high viscosity requiring steam flood or stream cycling in a well bore to achieve acceptable yields of fluids from the formation. Multiple azimuth sand filled fractures from a single well bore will greatly increase the zone of influence of a steam flood or steam cycling and result in higher rates of yield and lead to greater recovery of the petroleum fluids from the formation. The method is not applicable to consolidated brittle rock formations, in which the fracture azimuth is controlled by the rock formation stress regime.

Although the present invention contemplates the formation of fractures which generally extend laterally away from a vertical or near vertical well penetrating an earth formation and in a generally vertical plane in opposite directions from the well, i.e. a vertical two winged fracture, those skilled in the art will recognize that the invention may be carried out in earth formations wherein the fractures and the well bores can extend in directions other than vertical.

Therefore, the present invention provides a method and apparatus for controlling the azimuth of multiple vertical hydraulic fractures in a single well bore in formations of unconsolidated or weakly cemented sediments.

Other objects, features and advantages of the present invention will become apparent upon reviewing the following description of the preferred embodiments of the invention, when taken in conjunction with the drawings and the claims.

DETAILED DESCRIPTION OF THE DISCLOSED EMBODIMENT

Several embodiments of the present invention are described below and illustrated in the accompanying drawings. The present invention involves a method and apparatus for initiating and propagating multiple azimuth controlled vertical hydraulic fractures in subsurface formations of unconsolidated and weakly cemented sediments from a single well bore such as a petroleum production well. In addition, the present invention involves a method and apparatus for providing a high degree of hydraulic connection between the formed hydraulic fractures and the well bore to enhance production of petroleum fluids from the formation, and also to enable the fractures to be re-fractured individually to achieve thicker and more permeable in placed fractures within the formation.

Figure 1:
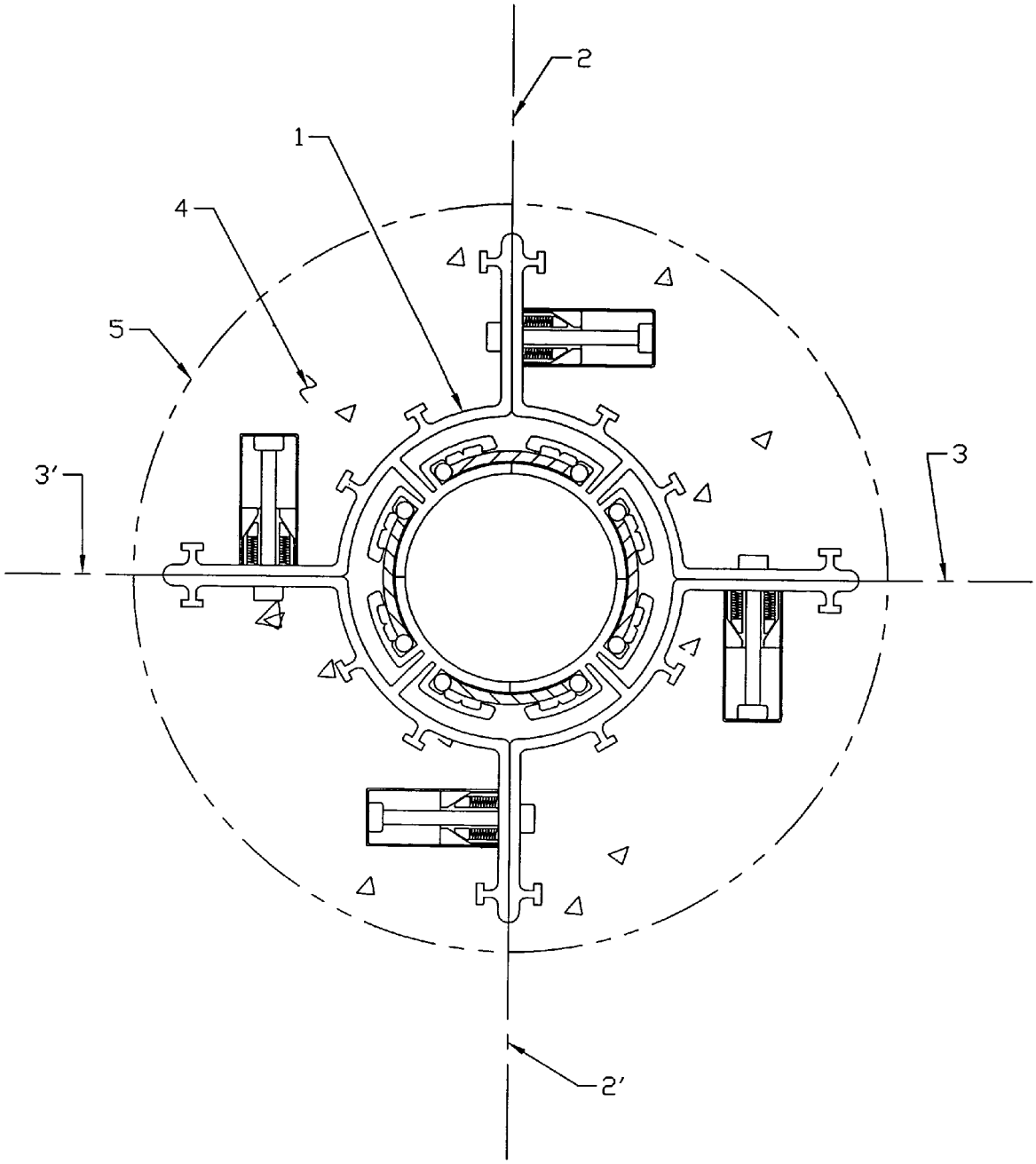
FIG. 1 is a horizontal cross-section view of a well casing having dual fracture winged initiation sections prior to initiation of multiple azimuth controlled vertical fractures.
Figure 2:
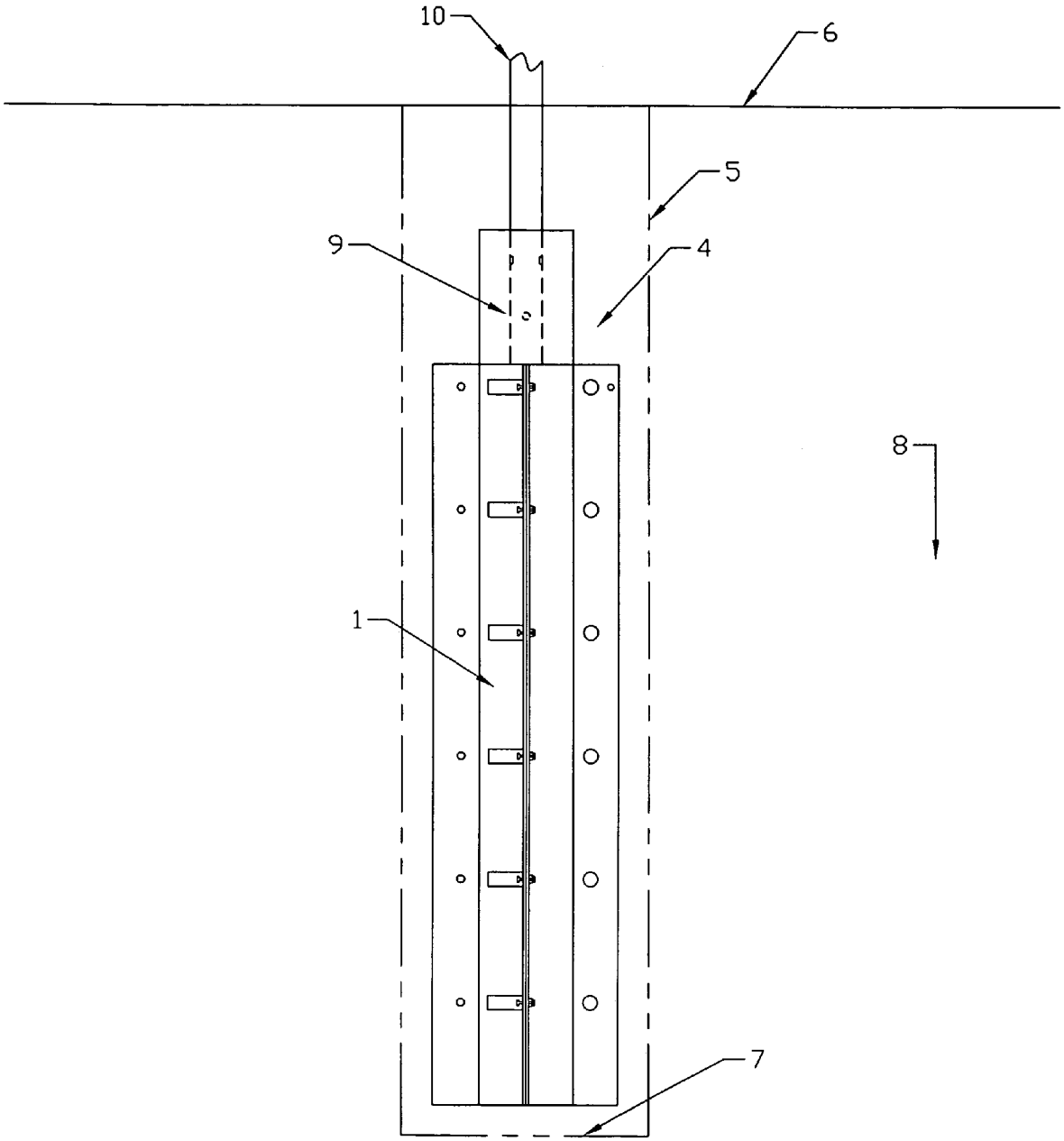
FIG. 2 is a cross-sectional side elevation view of a well casing having dual fracture winged initiation sections prior to initiation of multiple azimuth controlled vertical fractures.
Figure 3:
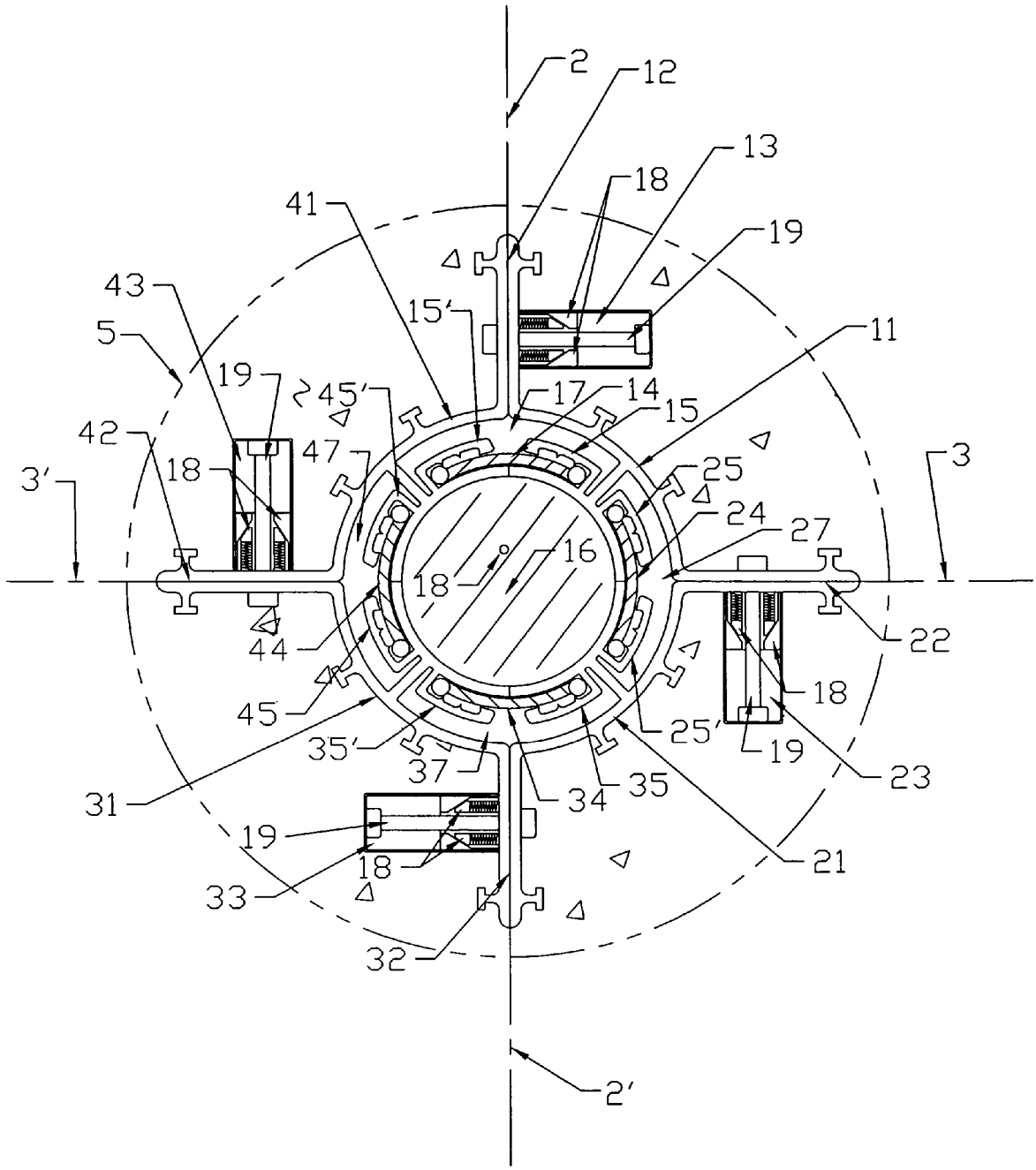
FIG. 3 is an enlarged horizontal cross-section view of a well casing having dual fracture winged initiation sections prior to initiation of multiple azimuth controlled vertical fractures.

Referring to the drawings, in which like numerals indicate like elements, FIGS. 1, 2, and 3 illustrate the initial setup of the method and apparatus for forming dual azimuth controlled vertical fractures. Conventional bore hole 5 is completed by wash rotary or cable tool methods into the formation 8 of unconsolidated or weakly cemented sediments to a predetermined depth 7 below the ground surface 6. Injection casing 1 is installed to the predetermined depth 7, and the installation is completed by placement of a grout 4 which completely fills the annular space between the outside the injection casing 1 and the bore hole 5. Injection casing 1 consists of four initiation sections 11, 21, 31 and 41 (FIG. 3) to produce two hydraulic partings 71 and 72 which in turn produce a first fracture orientated along plane 2, 2' and two hydraulic partings 81 and 82 which in turn produce a second fracture oriented along plane 3, 3' as shown on FIGS. 5 and 6. Injection casing 1 must be constructed from a material that can withstand the pressures that the fracture fluid exerts upon the interior of the injection casing 1 during the pressurization of the fracture fluid. The grout 4 can be any conventional material that preserves the spacing between the exterior of the injection casing 1 and the bore hole 5 throughout the fracturing procedure, preferably a non-shrink or low shrink cement based grout.

The outer surface of the injection casing 1 should be roughened or manufactured such that the grout 4 bonds to the injection casing 1 with a minimum strength equal to the down hole pressure required to initiate an azimuth controlled vertical fracture. The bond strength of the grout 4 to the outside surface of the casing 1 prevents the pressurized fracture fluid from short circuiting along the casing-to-grout interface up to the ground surface 6.

Referring to FIGS. 1, 2 and 3, the injection casing 1 comprises dual fracture winged initiation sections 11, 21, 31 and 32 installed at a predetermined depth 7 within the bore hole 5. The winged initiation sections 11, 21, 31 and 41 can be constructed from the same material as the injection casing 1. The winged initiation sections 11, 21, 31 and 41 are aligned parallel with and through the fracture planes 2, 2' and 3, 3'. The fracture planes 2, 2' and 3, 3' coincided with the first azimuth controlled vertical hydraulic fracture formed by partings 71 and 72 (FIG. 5) and the second azimuth controlled vertical hydraulic fracture formed by partings 81 and 82 (FIG. 6), respectively. The position below ground surface of the winged initiation sections 11, 21, 31 and 41 will depend on the required in situ geometry of the induced multiple azimuth hydraulic fractures and the reservoir formation properties and recoverable reserves.

Figure 5:
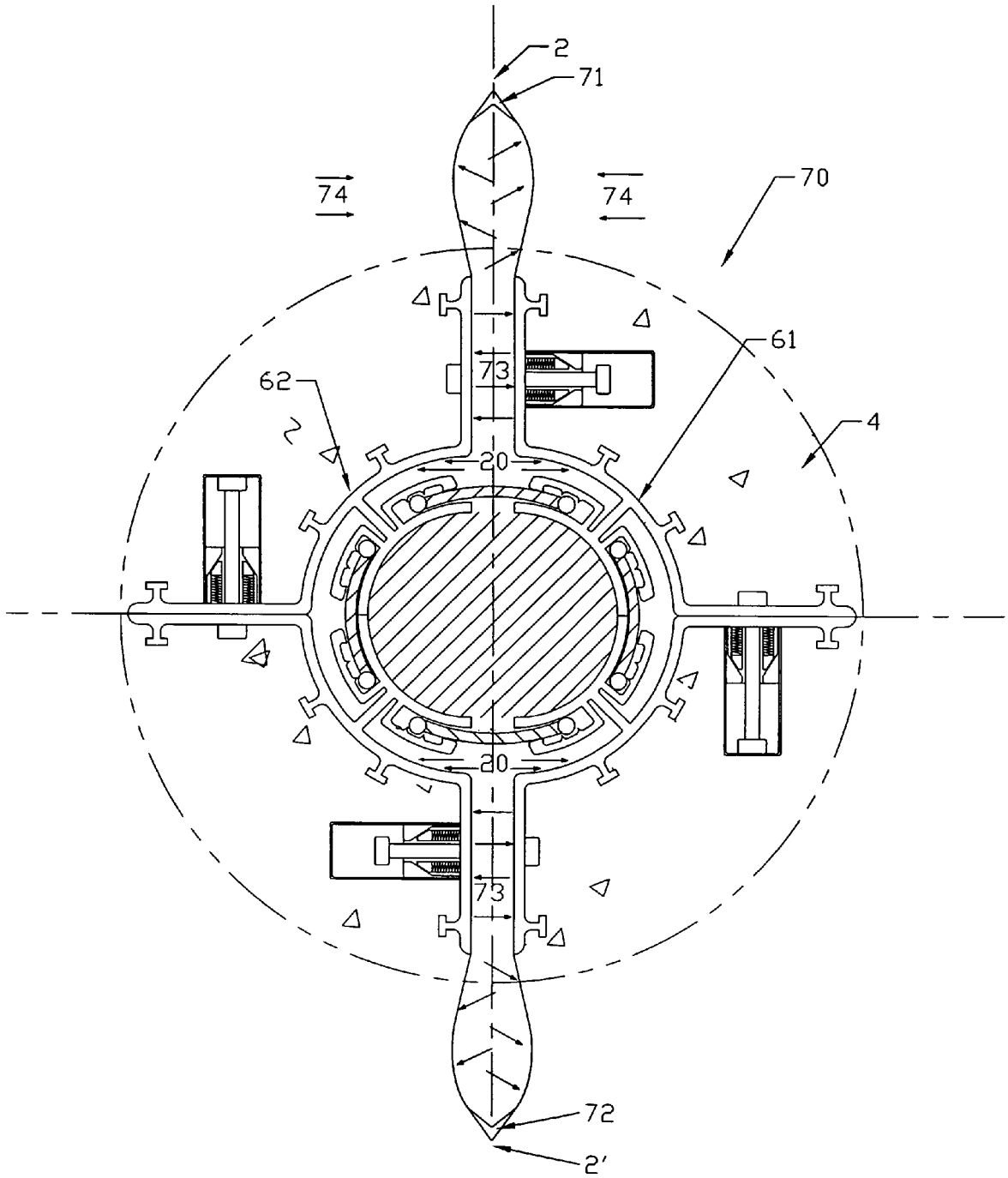
FIG. 5 is a horizontal cross-section view of a well casing having dual fracture winged initiation sections after initiation of a first azimuth controlled vertical fracture.
Figure 6:
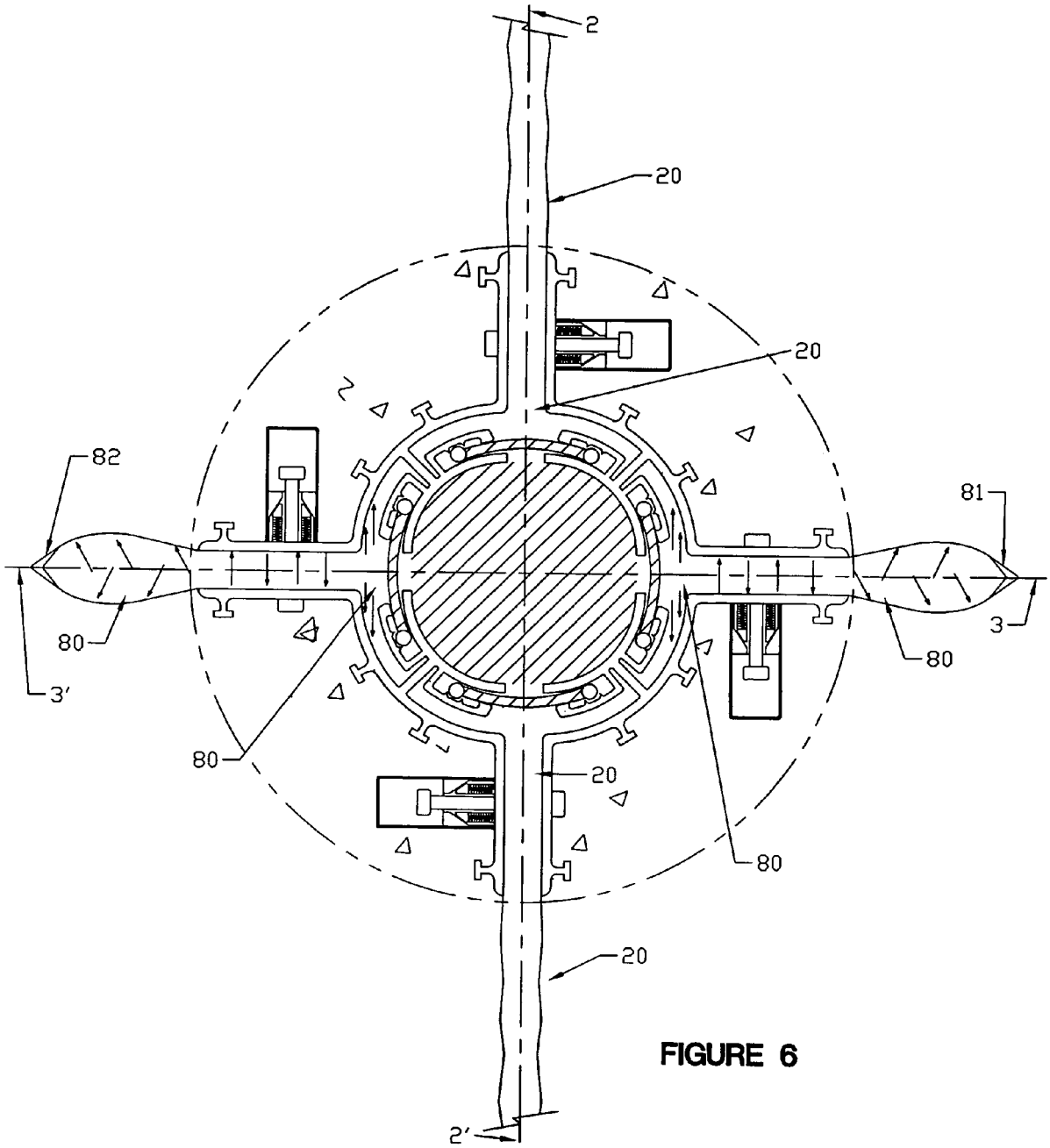
FIG. 6 is a horizontal cross-section view of a well casing having dual fracture winged initiation sections after initiation of a second azimuth controlled vertical fracture.

The winged initiation sections 11, 21, 31 and 41 of the well casing 1 are preferably constructed from four symmetrical quarters as shown on FIG. 3. The configuration of the winged initiation sections 11, 21, 31 and 41 is not limited to the shape shown, but the chosen configuration must permit the fracture to propagate laterally in at least two opposing directions along the fracture planes 2, 2' and 3, 3'. In FIG. 3, prior to initiating the fracture, the four symmetrical quarters of the winged initiation sections 11, 21, 31 and 41 are connected together by shear fasteners 13, 23, 33 and 43 and the four symmetrical quarters of the winged initiation sections 11, 21, 31 and 41 are sealed by gaskets 12, 22, 32 and 42. The gaskets 12, 22, 32 and 42 and the fasteners 13, 23, 33 and 43 are designed to keep the grout 4 from leaking into the interior of the winged initiation sections 11, 21, 31 and 41 during the grout 4 placement. The gaskets 12, 22, 32 and 42 align with the fracture planes 2, 2' and 3, 3' and define weakening lines between the winged initiation sections 11, 21, 31 and 41. Particularly, the winged initiation sections 11, 21, 31 and 41 are designed to separate along the weakening lines which coincide with the fracture planes 2, 2' and 3, 3'. During fracture initiation, as shown in FIGS. 5 and 6, the winged initiation sections 11, 21, 31 and 41 separate along the weakening lines without physical damage to the winged initiation sections 11, 21, 31 and 41. Any means of connecting the four symmetrical quarters of the winged initiation sections 11, 21, 31 and 41 can be used, including but not limited to clips, glue, or weakened fasteners, as long as the pressure exerted by the fastening means keeping the four symmetrical quarters of the winged initiation sections 11, 21, 31 and 41 together is greater than the pressure of the grout 4 on the exterior of the winged initiation sections 11, 21, 31 and 41. In other words, the fasteners 13, 23, 33 and 43 must be sufficient to prevent the grout 4 from leaking into the interior of the winged initiation sections 11, 21, 31 and 41. The fasteners 13, 23, 33 and 43 will open at a certain applied load during fracture initiation and progressively open further during fracture propagation and not close following the completion of the fracture. The fasteners 13, 23, 33 and 43 can consist of a variety of devices provided they have a distinct opening pressure, they progressively open during fracture installation, and they remain open even under ground closure stress following fracturing. The fasteners 13, 23, 33 and 43 also limit the maximum amount of opening of the four symmetrical quarters of the winged initiation sections 11, 21, 31 and 41. Particularly, each of the fasteners 13, 23, 33 and 43 comprises a spring loaded wedge 18 that allows the fastener to be progressively opened during fracturing and remain open under compressive stresses during ground closure following fracturing with the amount of opening permitted determined by the length of the bolt 19.

Figure 4:
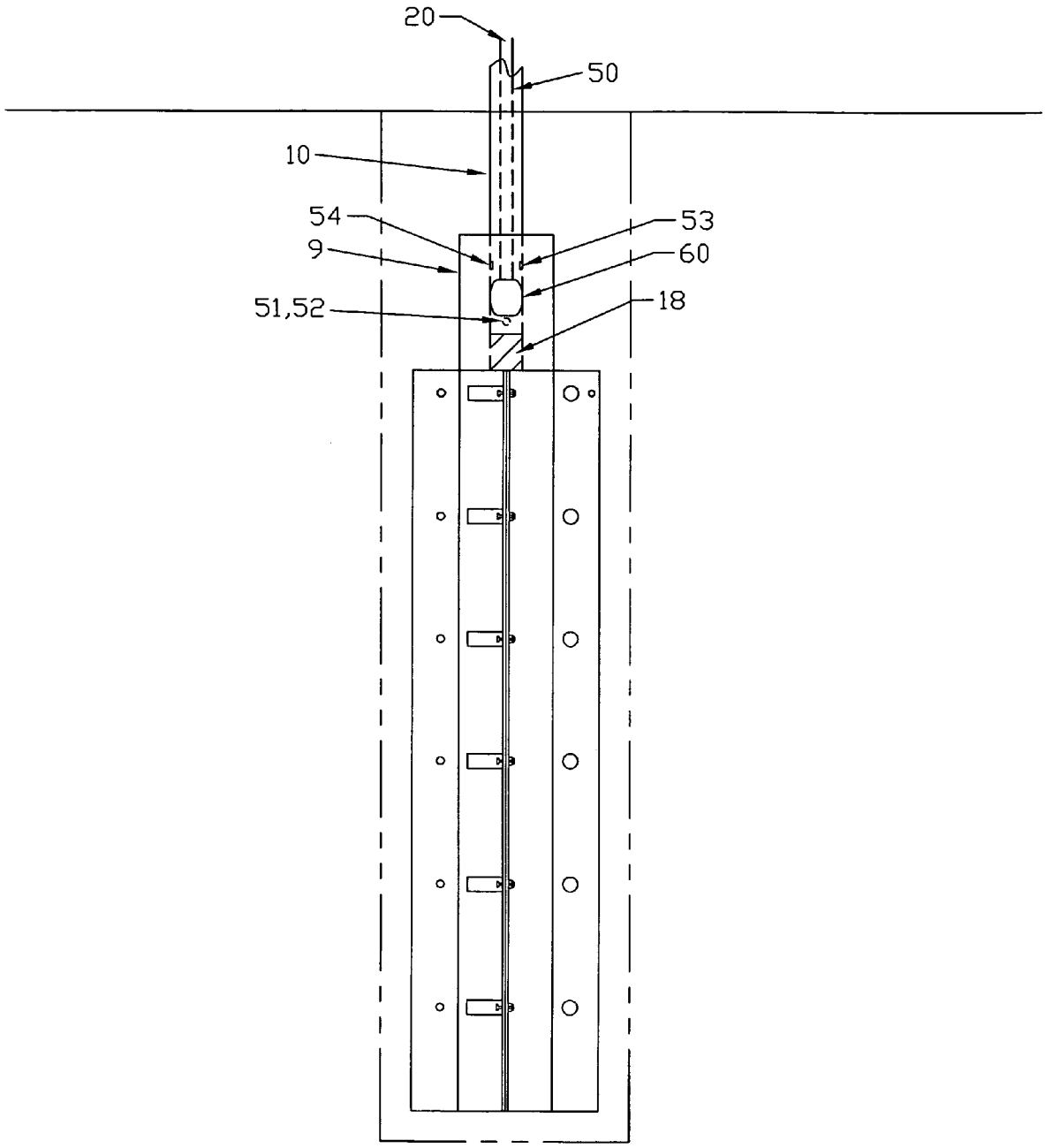
FIG. 4 is a cross-sectional side elevation view of a well casing having dual fracture winged initiation sections prior to initiation of multiple azimuth controlled vertical fractures.

Referring to FIG. 3, well screen sections 14, 24, 34 and 44 are contained in shear grip fastening sections 15, 15', 25, 25', 35, 35' and 45, 45' of adjacent winged initiation sections 11, 21, 31 and 41. The screen sections 14, 24, 34 and 44 are composed of conventional well screen material which limits the passage of soil particles from the formation into the well bore. The screen sections 14, 24, 34 and 44 are firmly held by the shear grip fasteners 15, 15', 25, 25', 35, 35' and 45, 45' to provide a limiting stress prior to either the sliding or yielding of the screen section within the grip fasteners 15, 15', 25, 25', 35, 35' and 45, 45' during fracture initiation and propagation as shown on FIGS. 5 and 6 for the first and second fractures respectively. Referring to FIGS. 3 and 4, the passages 17, 27, 37 and 47 are connected via the injection casing 1 top section 9 to openings 51, 52, 53 and 54 in the inner casing well bore passage 10, which is an extension of the well bore passage 16 in the injection casing initiation section.

Referring to FIGS. 3, 4, 5 and 6, prior to fracture initiation the inner casing well bore passage 10 and 16 is filled with sand 18 to below the lowest connecting openings 51 and 52. A single isolation packer 60 is lowered into the inner casing well bore passage 10 of the injection casing top section 9 and expanded within this section at a location immediately above the lowermost openings 51 and 52 as shown on FIG. 4. The fracture fluid 20 is pumped from the pumping system into the pressure pipe 50, through the single isolation packer 60, into the openings 51 and 52 and down to the passages 17 and 37 for initiation of the first fracture along the azimuth plane 2, 2'. Referring to FIG. 5, as the pressure of the fracture fluid 20 is increased to a level which exceeds the lateral earth pressures, the two symmetrical halves 61, 62 of the winged initiation sections 11, 21, 31 and 41 will begin to separate along the fracture plane 2, 2' of the winged initiation sections 11, 21, 31 and 41 during fracture initiation without physical damage to the two symmetrical halves 61, 62 of the winged initiation sections 11, 21, 31 and 41. As the two symmetrical halves 61, 62 separate, the gaskets 12 and 32 fracture, the fasteners 13 and 33 open, and the screen sections 14 and 34 slide in the shear grip fasteners 15, 15' and 35, 35' allowing separation of the two symmetrical halves 61, 62 along the fracture plane 2, 2', as shown in FIG. 5, without physical damage to the two symmetrical halves 61, 62 of the winged initiation sections 11, 21, 31 and 41. During separation of the two symmetrical halves 61, 62 of the winged initiation sections 11, 21, 31 and 41, the grout 4, which is bonded to the injection casing 1 (FIG. 5) and the two symmetrical halves 61, 62 of the winged initiation sections 11, 21, 31 and 41, will begin to dilate the adjacent sediments 70 forming a partings 71 and 72 of the soil 70 along the fracture plane 2, 2' of the planned azimuth controlled first vertical fracture. The fracture fluid 20 rapidly fills the partings 71 and 72 of the soil 70 to create the first fracture. Within the two symmetrical halves 61, 62 of the winged initiation sections 11, 21, 31 and 41, the fracture fluid 20 exerts normal forces 73 on the soil 70 perpendicular to the fracture plane 2, 2' and opposite to the soil 70 horizontal stresses 74. Thus, the fracture fluid 20 progressively extends the partings 71 and 72 and continues to maintain the required azimuth of the initiated first fracture along the plane 2, 2'. The azimuth controlled first vertical fracture will be expanded by continuous pumping of the fracture fluid 20 until the desired geometry of the first azimuth controlled hydraulic fracture is achieved.

Following completion of the first fracture, referring to FIGS. 3, 4, 5 and 6, the single isolation packer 60 is raised in the injection casing well bore 10 to above the next openings 53 and 54 which are connected to the passages 27 and 47 respectively. The fracture fluid 20 in the first fracture installation is either rapidly broken by application of an enzyme or acid to give rise to settling of the sand proppant in the fracture fluid and thus causes sand to settle in the passages 17 and 37 and/or additional sand is placed in passages 17 and 37 and well bore 10 to just below openings 53 and 54, so that the fracture fluid 80 used in the second fracture injection will not give rise to further propagation of the first fracture due to the high bridging stress provided by the sand in passages 17 and 37 and thus the fracture fluid 80 will preferentially pass through openings 53 and 54 and passages 27 and 47 to initiation the second fracture on the azimuth plane 3, 3'. As the fracture fluid 80 pressure increases below the single isolation packer 60, the azimuth controlled second vertical fracture is initiated and propagated along the plane 3, 3' as previously described for the first initiated fracture on the different azimuth plane 2, 2'.

Following completion of the second fracture and breaking of the fracture fluid 80, the sand in the injection casing well bore passages 10 and 16 are washed out and the injection casing acts as a production well bore for extraction of fluids from the formation at the depths and extents of the recently formed hydraulic fractures. The well screen sections 14, 24, 34 and 44 span the opening of the well casing created by the first and second fractures and act as conventional well screen preventing proppant flow back into the production well bore passages 16 and 10. The fasteners 13, 23, 33 and 43 remain open thereby providing a high degree of hydraulic connection between the well bore passage 16 and the fractures and thus the formation. If necessary and prior to washing the sand from the production well bore passages 10 and 16 for fluid extraction from the formation, it is possible to re-fracture the already formed fractures by first washing out the sand in passages 17 and 37 through the openings 51 and 52 and thus re-fracture the first initiated fracture. Re-fracturing the fractures can enable thicker and more permeable fractures to be created in the formation. Likewise, the second fracture can be re-fractured by washing the sand from the passages 27 and 47 through the openings 53 and 54, similar to re-fracturing the first fracture as described earlier.

Referring to FIGS. 4, 5 and 6, once the fracture is initiated, injection of a fracture fluid 20 and 80 through the well bore passage 10 in the injection casing 1, into the inner passages 17, 27 37 and 47 of the initiation sections 11, 21, 31 and 41, and into the initiated fractures can be made by any conventional means to pressurize the fracture fluid 20 and 80. The conventional means can include any pumping arrangement to place the fracture fluid 20 and 80 under the pressure necessary to transport the fracture fluid 20 and 80 and the proppant into the initiated fractures to assist in fracture propagation and to create multiple azimuth vertical permeable proppant filled fractures in the subsurface formation. For successful fracture initiation and propagation to the desired size and fracture permeability, the preferred embodiment of the fracture fluid 20 and 80 should have the following characteristics.

The fracture fluid 20 and 80 should not excessively leak off or lose its liquid fraction into the adjacent unconsolidated soils and sediments. The fracture fluid 20 and 80 should be able to carry the solids fraction (the proppant) of the fracture fluid 20 and 80 at low flow velocities that are encountered at the edges of a maturing azimuth controlled vertical fracture. The fracture fluid 20 should have the functional properties for its end use such as longevity, strength, porosity, permeability, etc.

The fracture fluid 20 and 80 should be compatible with the proppant, the subsurface formation, and the formation fluids. Further, the fracture fluid 20 and 80 should be capable of controlling its viscosity to carry the proppant throughout the extent of the induced fracture in the formation. The fracture fluid 20 and 80 should be an efficient fluid, i.e. low leak off from the fracture into the formation, to be clean breaking with minimal residue, and to have a low friction coefficient. The fracture fluid 20 and 80 should not excessively leak off or lose its liquid fraction into the adjacent unconsolidated or weakly cemented formation. For permeable fractures, the gel composed of starch should be capable of being degraded leaving minimal residue and not impart the properties of the fracture proppant. A low friction coefficient fluid is required to reduce pumping head losses in piping and down the well bore. When a hydraulic permeable fracture is desired, typically a gel is used with the proppant and the fracture fluid. Preferable gels can comprise, without limitation of the following: a water-based guar gum gel, hydroxypropylguar (HPG), a natural polymer or a cellulose-based gel, such as carboxymethylhydroxyethylcellulose (CMHEC).

The gel is generally cross-linked to achieve a sufficiently high viscosity to transport the proppant to the extremes of the fracture. Cross-linkers are typically metallic ions, such as borate, antimony, zirconium, etc., disbursed between the polymers and produce a strong attraction between the metallic ion and the hydroxyl or carboxy groups. The gel is water soluble in the uncrossed-linked state and water insoluble in the cross-linked state. While cross-linked, the gel can be extremely viscous thereby ensuring that the proppant remains suspended at all times. An enzyme breaker an be added to controllably degrade the viscous cross-linked gel into water and sugars. The enzyme typically takes a number of hours to biodegrade the gel, and upon breaking the cross-link and degradation of the gel, a permeable fracture filled with the proppant remains in the formation with minimal gel residue. For certain proppants, pH buffers can be added to the gel to ensure the gel's in situ pH is within a suitable range for enzyme activity.

The fracture fluid-gel-proppant mixture is injected into the formation and carries the proppant to the extremes of the fracture. Upon propagation of the fracture to the required lateral and vertical extent, the predetermined fracture thickness may need to be increased by utilizing the process of tip screen out or by re-fracturing the already induced fractures. The tip screen out process involves modifying the proppant loading and/or fracture fluid 20 and 80 properties to achieve a proppant bridge at the fracture tip. The fracture fluid 20 and 80 is further injected after tip screen out, but rather then extending the fracture laterally or vertically, the injected fluid widens, i.e. thickens, the fracture. Re-fracturing of the already induced fractures enables thicker and more permeable fractures to be installed, and also provides the ability to preferentially inject steam, carbon dioxide, chemicals, etc to provide enhanced recovery of the petroleum fluids from the formation.

The density of the fracture fluid 20 and 80 can be altered by increasing or decreasing the proppant loading or modifying the density of the proppant material. In many cases, the fracture fluid 20 and 80 density will be controlled to ensure the fracture propagates downwards initially and achieves the required height of the planned fracture. Such downward fracture propagation depends on the in situ horizontal formation stress gradient with depth and requires the gel density to be typically greater than 1.25 gm/cc.

The viscosity of the fracture fluid 20 and 80 should be sufficiently high to ensure the proppant remains suspended during injection into the subsurface, otherwise dense proppant materials will sink or settle out and light proppant materials will flow or rise in the fracture fluid 20 and 80. The required viscosity of the fracture fluid 20 and 80 depends on the density contrast of the proppant and the gel and the proppant's maximum particulate diameter. For medium grain-size particles, that is of grain size similar to a medium sand, a fracture fluid 20 and 80 viscosity needs to be typically greater than 100 centipoise at a shear rate of 1/sec.

Figure 7:
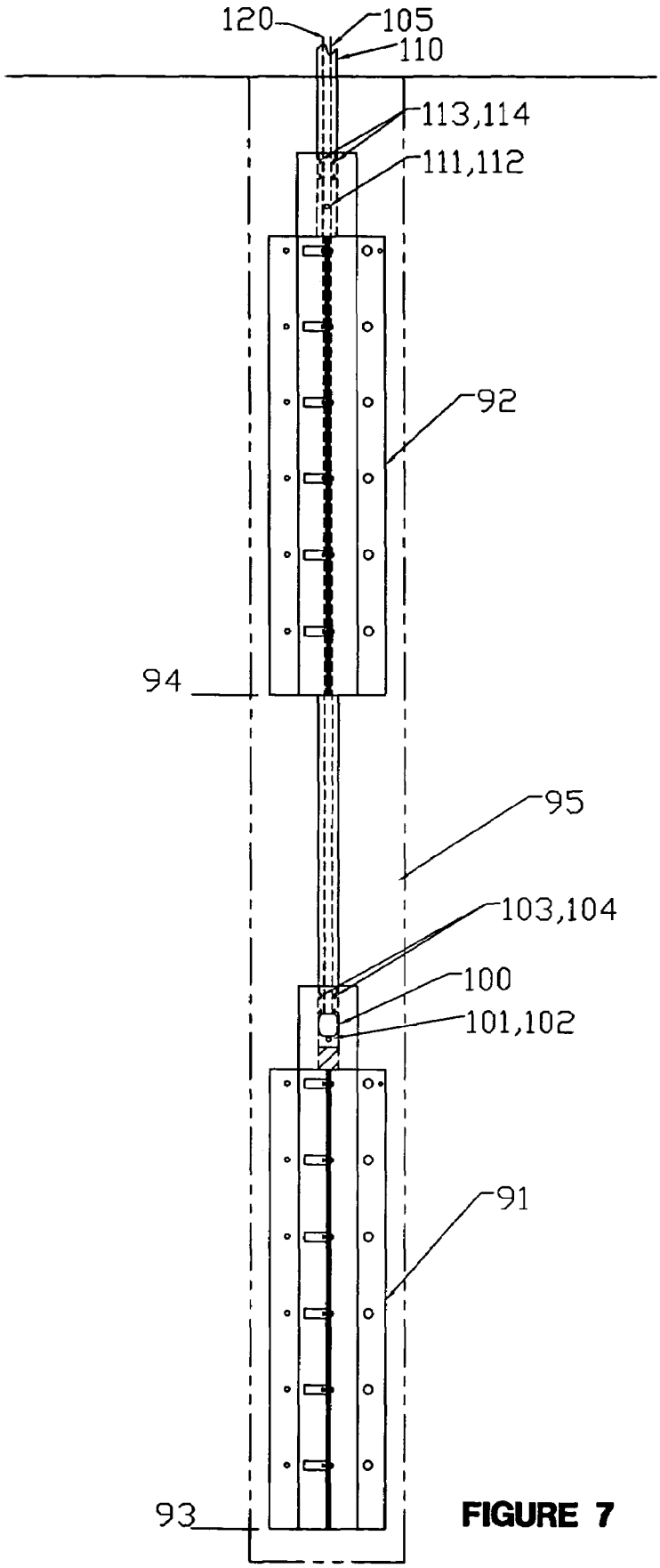
FIG. 7 is a cross-sectional side elevation view of two injection well casings each having dual fracture winged initiation sections at each located at two distinct depths prior to initiation of multiple azimuth controlled vertical fractures.

Referring to FIG. 7, two injection casings 91 and 92 are set at different distinct depths 93 and 94 in the bore hole 95 and grouted into the formation by grout filling the annular space between the injection casings 91 and 92 and the bore hole 95. The lower injection casing 91 is fractured first, by filling the well bore passage 110 with sand to just below the openings 101 and 102. The isolation packer 100 is lowered into the well bore passage 110 to just above the openings 101 and 102 and expanded in the well bore passage 110. The fracture fluid 120 is pumped into the isolation packer pipe string 105 and passes through the isolation packer 100 and into the openings 101 and 102 to initiate the first vertical hydraulic fracture at the first required fracture azimuth as described earlier. Upon completion of the first fracture in the first injection casing 91, the isolation packer 100 is raised to just above the openings 103 and 104, and the second fracture is initiated in the first injection casing 91 as earlier described. Following completion of the fractures in the first injection casing 91, the process is repeated by raising the isolation packer 100 to just above the openings 111 and 112 to initiate the first fracture in the second injection casing 92, and the whole process is repeated to create all of the fractures in the injection casings installed in the bore hole 95.

Figure 8:
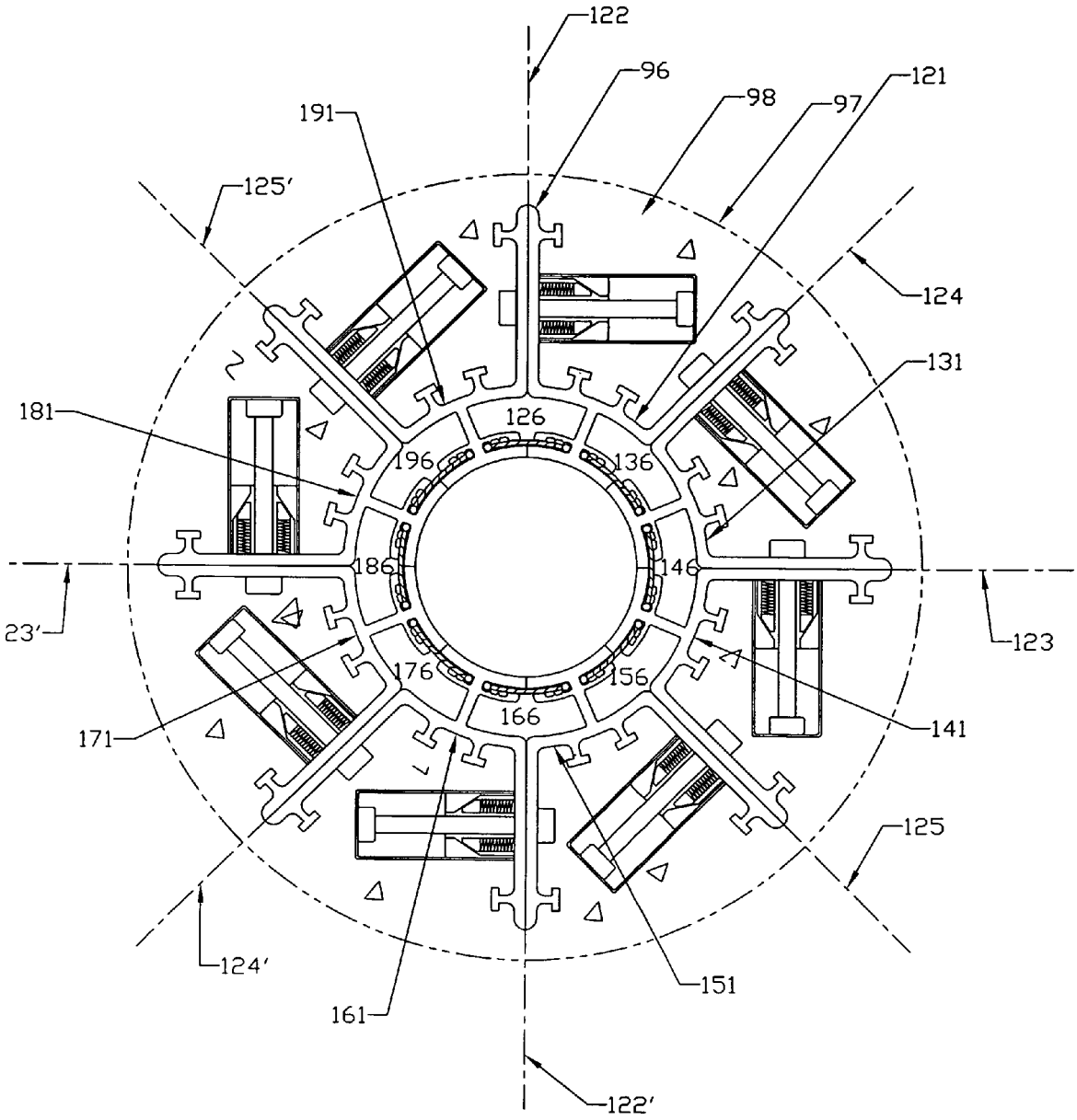
FIG. 8 is an enlarged horizontal cross-section view of a well casing having four fracture winged initiation sections prior to initiation of multiple azimuth controlled vertical fractures.
Figure 9:
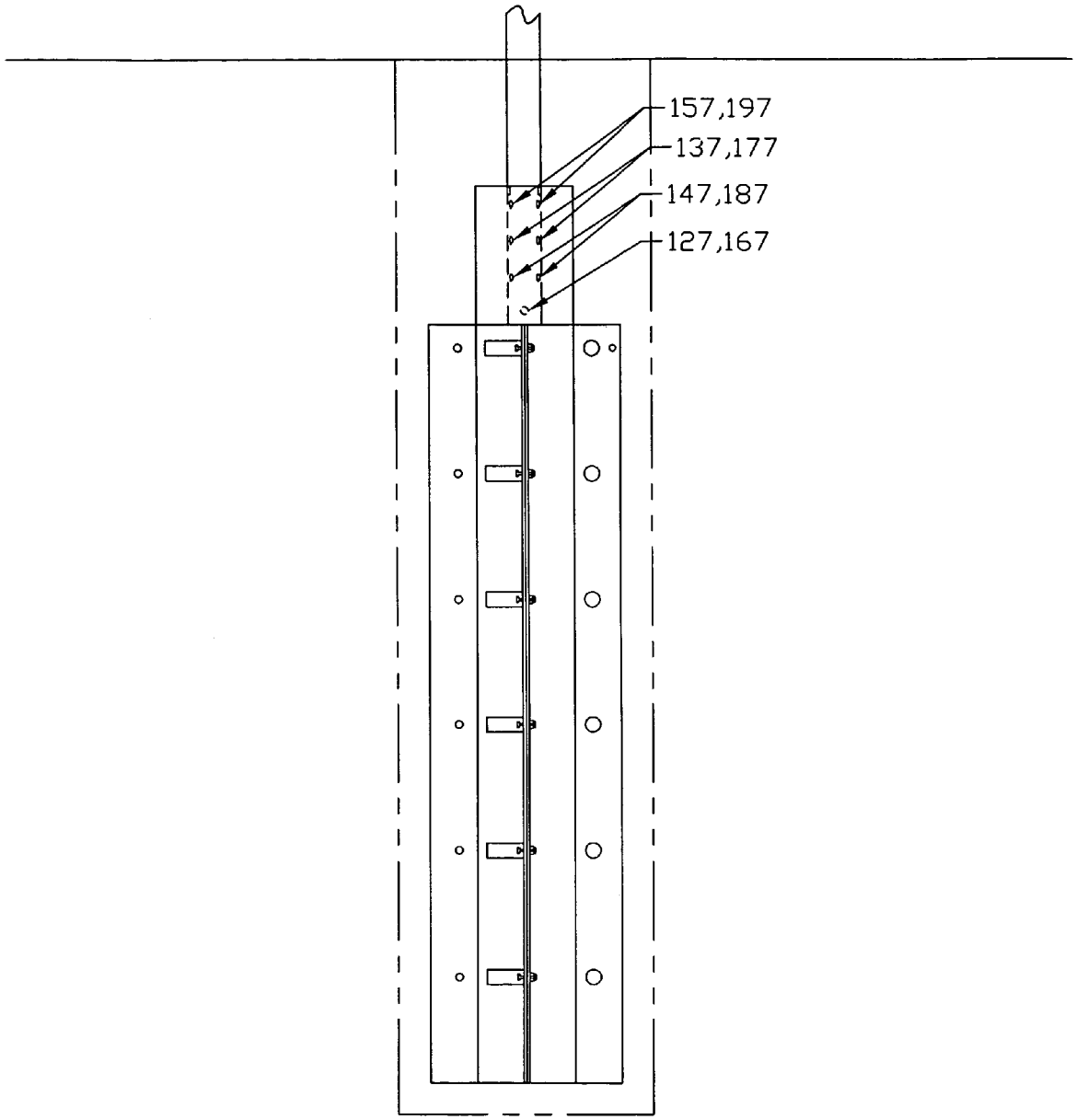
FIG. 9 is a cross-sectional side elevation view of a well casing having four fracture winged initiation sections prior to initiation of multiple azimuth controlled vertical fractures.
Figure 10:
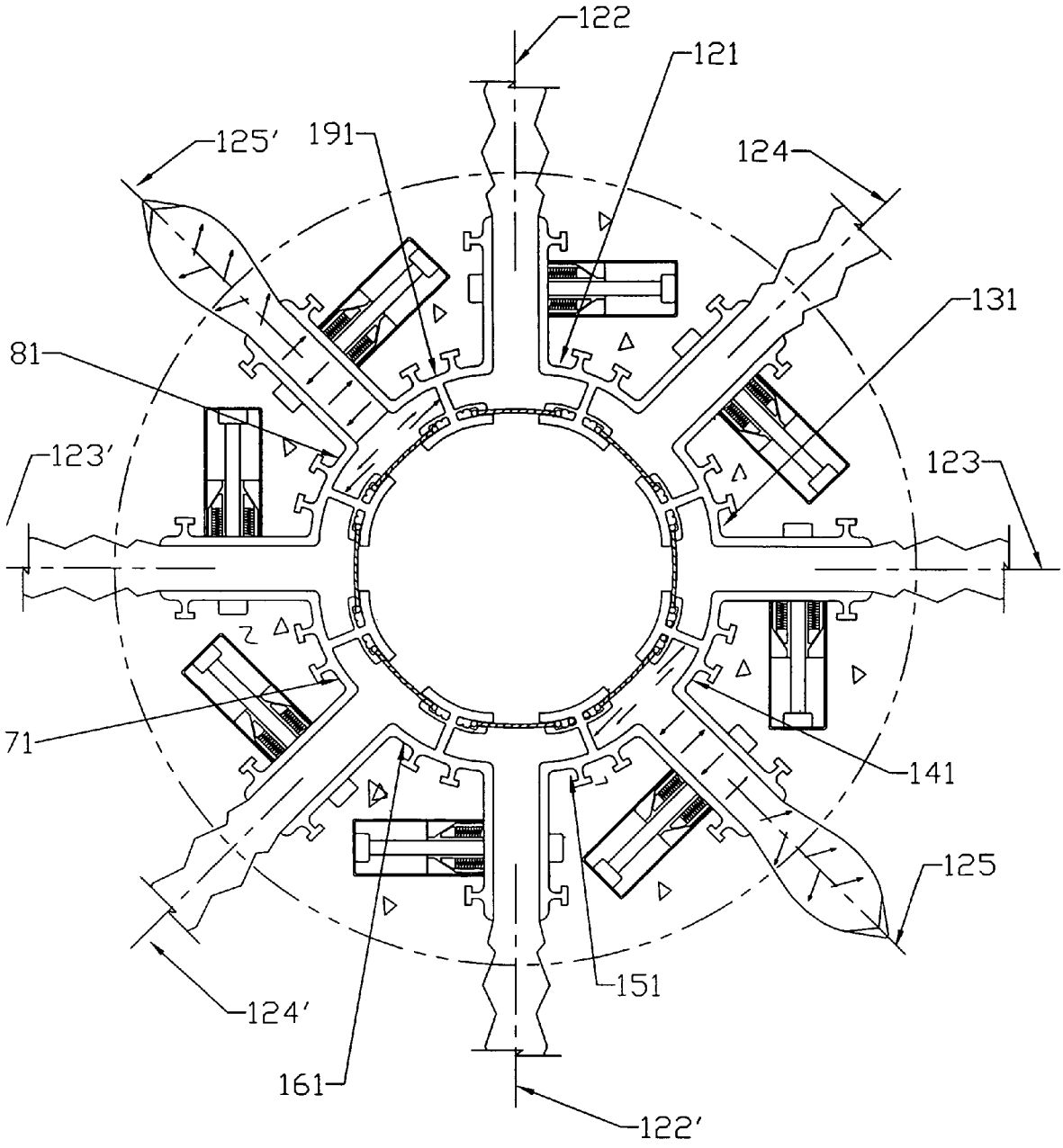
FIG. 10 is a horizontal cross-section view of a well casing having four fracture winged initiation sections after initiation of a fourth azimuth controlled vertical fracture.

Another embodiment of the present invention is shown on FIGS. 8, 9 and 10, consisting of an injection casing 96 inserted in a bore hole 97 and grouted in place by a grout 98. The injection casing 96 consists of eight symmetrical fracture initiation sections 121, 131, 141, 151, 161, 171, 181 and 191 to install a total of four hydraulic fractures on the different azimuth planes 122, 122', 123, 123', 124, 124' and 125, 125'. The passage for the first initiated fracture inducing passages 126 and 166 are connected to the openings 127 and 167, and the first fracture is initiated and propagated along the azimuth plane 122, 122' as described earlier. The second fracture inducing passages 146 and 186 are connected to the openings 147 and 187, and the second fracture is initiated and propagated along the azimuth plane 123, 123' as described earlier. The third fracture inducing passages 136 and 176 are connected to the openings 137 and 177, and the third fracture is initiated and propagated along the azimuth plane 124, 124' as described for the earlier installed fractures. The fourth fracture inducing passages 156 and 196 are connected to the openings 157 and 197, and the fourth fracture is initiated and propagated along the azimuth plane 125, 125' as described for the earlier installed fractures. The process results in four hydraulic fractures installed from a single well bore at different azimuths as shown on FIG. 10.

Finally, it will be understood that the preferred embodiment has been disclosed by way of example, and that other modifications may occur to those skilled in the art without departing from the scope and spirit of the appended claims.

What is claimed is:

1. A method for creating multiple vertical hydraulic fractures oriented at differing azimuths in a formation of unconsolidated and weakly cemented sediments, comprising:

a. drilling a bore hole in the formation to a predetermined depth;

b. installing an injection casing in the bore hole at the predetermined depth;

c. injecting a fracture fluid into the injection casing with sufficient fracturing pressure to dilate the injection casing and the formation in a first preferential direction and thereby initiate a first vertical fracture at a first azimuth orthogonal to the first direction of dilation; and d. further injecting the fracture fluid into the injection casing with sufficient fracturing pressure to dilate the injection casing and the formation in a second preferential direction different from the first preferential direction, e. preventing the fracture fluid from entering the first vertical fracture and thereby initiating a second vertical fracture at a second azimuth orthogonal to the second preferential direction of dilation.

2. The method of claim 1, wherein the method further comprises:

a. installing the injection casing at a predetermined depth in the bore hole, wherein an annular space exists between the outer surface of the casing and the bore hole, b. filling the annular space with a grout that bonds to the outer surface of the casing, wherein the casing has multiple initiation sections separated by weakening lines so that the initiation sections separate along the weakening lines under the fracturing pressure.

3. The method of claim 2, wherein the fracture fluid dilates the grout and the formation to initiate the first fracture in the formation at a first weakening line and subsequently the fracture fluid dilates the grout and formation to initiate the second fracture in the formation at a second weakening line.

4. The method of claim 1, wherein the fracture fluid does not leak off into the formation from the fracture.

5. The method of claim 1, wherein the fracture fluid comprises a proppant, and the fracture fluid is able to carry the proppant of the fracture fluid at low flow velocities.

6. The method claim 1, wherein the fracture fluid is clean breaking with minimal residue.

7. The method of claim 1, wherein the fracture fluid has a low friction coefficient.

8. The method of claim 1, wherein the fracture fluid comprises a water based guar gum gel slurry.

9. The method of claim 3, wherein the casing comprises two initiation sections with two directions of dilation and the first and second weakening lines are orthogonal.

10. The method of claim 3, wherein the casing comprises thee initiation sections with three directions of dilation.

11. The method of claim 3, wherein the casing comprises four initiation sections with four directions of dilation, with the first and second weakening lines being orthogonal to each other and the third and fourth weakening lines being orthogonal to each other.

12. The method of claim 2, wherein the initiation sections remain separated after dilation of the casing by the fracture fluid to provide hydraulic connection of the first and second fractures wit the well bore following completion of hydraulic fracturing.

13. The method of claim 2, wherein the fracture fluid comprises a proppant and the initiation sections each contain well screen sections separating the proppant in the hydraulic fractures from the production well bore and thus preventing proppant from flowing back from the fracture into the production well bore during fluid extraction.

14. The method of claim 1, wherein the method further comprises re-fracturing of each previously injected fractures.

15. The method of claim 1, wherein the dilation of the formation is achieved by first cutting a vertical slot in the formation at the required azimuth for the first initiated fracture, injecting a fracture fluid into the slot with a sufficient fracturing pressure to dilate the formation in this first preferential direction and thereby initiate the first vertical fracture at an azimuth orthogonal to the first direction of dilation; and following the first fracture injection, by subsequently injecting the fracture fluid into the second and subsequent slot cut into the formation at the required fracture azimuth with a sufficient fracturing pressure to dilate the formation in the second and subsequent preferential direction at a different azimuth to the first and subsequent preferential directions, preventing the fracture fluid from entering the first and subsequent earlier vertical fractures and thereby initiate a second and subsequent vertical fracture at an azimuth orthogonal to the second and subsequent direction of dilation.

16. A well in a formation of unconsolidated and weakly cemented sediments, comprising a bore hole in the formation to a predetermined depth; an injection casing in the bore hole at the predetermined depth; a source for delivering a fracture fluid into the injection casing with sufficient fracturing pressure to dilate the injection casing and the formation and initiate a vertical fracture at an azimuth orthogonal to a direction of dilation, wherein the injection casing further comprises:

a. multiple initiation, sections separated by weakening lines, b. multiple passages within the initiation sections and communicating across the weakening lines for the introduction of the fracture fluid to dilate the casing and separate the initiation sections along the weakening lines, wherein the passages are selectably interconnected to the source of fracture fluid to dilate the injection casing and the formation in a first preferential direction and thereby initiate a first vertical fracture at a first azimuth orthogonal to the first direction of dilation and to dilate the injection casing and the formation in a second preferential direction different from the first preferential direction and thereby initiate a second vertical fracture at a second azimuth orthogonal to the second direction of dilation.

17. The well of claim 16, wherein the fracture fluid does not leak off into the formation from the fracture.

18. The well of claim 16, wherein the fracture fluid comprises a proppant, and the fracture fluid is able to carry the proppant of the fracture fluid at low flow velocities.

19. The well claim 16, wherein the fracture fluid is clean breaking with minimal residue.

20. The well of claim 16, wherein the fracture fluid has a low friction coefficient.

21. The well of claim 16, wherein the fracture fluid comprises a water based guar gum gel slurry.

22. The well of claim 16, wherein the initiation sections remain separated after dilation of the casing by the fracture fluid to provide hydraulic connection of the first and second fractures with the well bore following completion of hydraulic fracturing.

23. The well of claim 16, wherein the fracture fluid comprises a proppant and the initiation sections each contain well screen sections separating the proppant in the hydraulic fractures from the production well bore and thus preventing proppant from flowing back from the fracture into the production well bore during petroleum fluid extraction.

24. A well in a formation of unconsolidated and weakly cemented sediments, comprising a bore hole in the formation to a predetermined depth; an injection casing in the bore hole at the predetermined depth, the injection casing comprising multiple initiation sections separated by weakening lines, passages within the initiation sections communicate a fracture fluid to a selected weakening line, wherein each weakening line corresponds to one of a plurality of fracture planes; and a source for delivering the fracture fluid with sufficient pressure to separate the initiation sections adjacent the selected weakening lines, dilate the formation, and initiate a fracture in the formation along the desired fracture plane.

25. A well in a formation of unconsolidated and weakly cemented sediments, comprising a bore hole in the formation to a predetermined depth; an injection casing in the bore hole at the predetermined depth, the injection casing comprising multiple initiation sections separated by weakening lines, passages within the initiation sections communicate a fracture fluid to a selected opposed pair of weakening lines, wherein each opposed pair of weakening lines correspond to one of a plurality of desired fracture planes; and a source for delivering the fracture fluid with sufficient pressure to separate the initiation sections adjacent the selected opposed pairs of weakening lines, dilate the formation, and initiate a fracture in the formation along the desired fracture plane.

* * * * *